US010695840B2

(12) United States Patent
Kim et al.

(10) Patent No.: US 10,695,840 B2
(45) Date of Patent: Jun. 30, 2020

(54) SINTERED MAGNET BASED ON MNBI HAVING IMPROVED HEAT STABILITY AND METHOD OF PREPARING THE SAME

(71) Applicant: LG ELECTRONICS INC., Seoul (KR)

(72) Inventors: Jinbae Kim, Seoul (KR); Yangwoo Byun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 395 days.

(21) Appl. No.: 15/153,417

(22) Filed: May 12, 2016

(65) Prior Publication Data

US 2016/0322134 A1 Nov. 3, 2016

Related U.S. Application Data

(63) Continuation of application No. PCT/KR2015/006434, filed on Jun. 24, 2015.

(30) Foreign Application Priority Data

Apr. 29, 2015 (KR) ..... 10-2015-0060676

(51) Int. Cl.

| | |
|---|---|
| ***B22F 9/04*** | (2006.01) |
| ***H01F 1/01*** | (2006.01) |
| ***B22F 3/16*** | (2006.01) |
| ***H01F 1/08*** | (2006.01) |
| ***H01F 41/02*** | (2006.01) |
| ***B22F 9/00*** | (2006.01) |

(Continued)

(52) U.S. Cl.

CPC ..... *B22F 9/04* (2013.01); *B22F 9/008* (2013.01); *C22C 1/0491* (2013.01); *C22C 12/00* (2013.01); *C22C 22/00* (2013.01); *H01F 1/047* (2013.01); *H01F 1/086* (2013.01); *H01F 41/0273* (2013.01); *B22F 2009/048* (2013.01); *B22F 2998/10* (2013.01); *B22F 2999/00* (2013.01); *C22C 2200/04* (2013.01); *H01F 1/0579* (2013.01)

(58) Field of Classification Search

None

See application file for complete search history.

(56) References Cited

U.S. PATENT DOCUMENTS

| | | | |
|---|---|---|---|
| 2004/0154699 | A1 | 8/2004 | Chen et al. |
| 2011/0210283 | A1 | 9/2011 | Ramirez et al. |

(Continued)

FOREIGN PATENT DOCUMENTS

| | | | |
|---|---|---|---|
| CN | 102610346 | A | 7/2012 |
| CN | 103071942 | A | 5/2013 |

(Continued)

OTHER PUBLICATIONS

Translation of JP56166349A (Year: 1981).*

(Continued)

*Primary Examiner* — Xiaowei Su

(74) *Attorney, Agent, or Firm* — Birch, Stewart, Kolasch & Birch, LLP

(57) ABSTRACT

Disclosed are an MnBi sintered magnet exhibiting excellent thermal stability as well as excellent magnetic characteristics at high temperature, an MnBi anisotropic complex sintered magnet, and a method of preparing the same.

6 Claims, 3 Drawing Sheets

(51) Int. Cl.

| | |
|---|---|
| ***H01F 1/047*** | (2006.01) |
| ***C22C 1/04*** | (2006.01) |
| ***C22C 12/00*** | (2006.01) |
| ***C22C 22/00*** | (2006.01) |
| *H01F 1/057* | (2006.01) |

(56) References Cited

U.S. PATENT DOCUMENTS

| | | | | |
|---|---|---|---|---|
| 2014/0132376 | A1 | 5/2014 | Jin | |
| 2016/0093425 | A1* | 3/2016 | Li | H01F 1/0577 419/30 |

FOREIGN PATENT DOCUMENTS

| | | | | |
|---|---|---|---|---|
| EP | 0249973 | A1 * | 12/1987 | B22F 1/0003 |
| EP | 3288043 | A1 | 2/2018 | |
| JP | 56166349 | A * | 12/1981 | |
| JP | 3-101102 | A | 4/1991 | |
| JP | 7-320918 | A | 12/1995 | |
| JP | 10-335124 | A | 12/1998 | |
| JP | 2008-255436 | A | 10/2008 | |
| JP | 2012-124189 | A | 6/2012 | |
| KR | 1020050122201 | A | 12/2005 | |
| WO | WO 2012/159096 | A2 | 11/2012 | |

OTHER PUBLICATIONS

Yang et al., Journal of Applied Physics, vol. 111, 07E312. (Year: 2012).*

Cao et al., Journal od Applied Physics, vol. 109, No. 07A740. (Year: 2011).*

Thesis: "A study on the magnetic properties of MnBi magnets fabricated by Spark Plasma Sintering Process", Dec. 2003, pp. 1-82 (88 pages).

Cao et al., "Magnetic properties and thermal stability of MnBi/NdFeB hybrid bonded magnets," Journal of Applied Physics, vol. 109, 2011 (Published online Apr. 11, 2011), pp. 07A740-1-07A740-3.

Moon et al., "Synthesis and Magnetic Properties of MnBi(LTP) Magnets With High-Energy Product," IEEE Transactions on Magnetics, vol. 50, No. 11, Nov. 18, 2014, 4 pages.

Rao et al., "Anisotropic MnBi/$Sm_2Fe_{17}N_x$ Hybrid Magnets Fabricated by Hot Compaction," IEEE Transactions on Magnetics, Vo. 49, No. 7, Jul. 15, 2013, pp. 3255-3257.

Yang et al., "Magnetic properties of the anisotropic MnBi/$Sm_2Fe_{17}N_x$ hybrid magnet," Journal of Applied Physics, vol. 115, 2014 (Published online Feb. 12, 2014), pp. 17A721-1-17A721-3.

Yang et al., "Temperature dependences of structure and coercivity for melt-spun MnBi compound," Journal of Magnetism and Magnetic Materials, vol. 330, 2013 (Available online Nov. 5, 2012), pp. 106-110.

Cui et al., "Thermal stability of MnBi magnetic materials," J. Phys.: Condens. Matter, vol. 26, 064212, Jan. 27, 2014, pp. 1-10.

Guo et al., "The formation of single-phase equiatomic MnBi by rapid solidification," J. Mater. Res., vol. 5, No. 11, Nov. 1990, 2646-2651.

Huang et al., "Metal-bonded Sm2Fe17-N-type magnets," J. Appl. Phys., vol. 70, No. 10, Nov. 15, 1991, pp. 6027-6029.

Rodewald et al., "Microstructure and magnetic properties of Zn- or Sn-bonded Sm2Fe17Nx magnets," J. Appl. Phys., vol. 73, No. 10, May 15, 1993, pp. 5899-5901.

* cited by examiner

【Fig. 1】
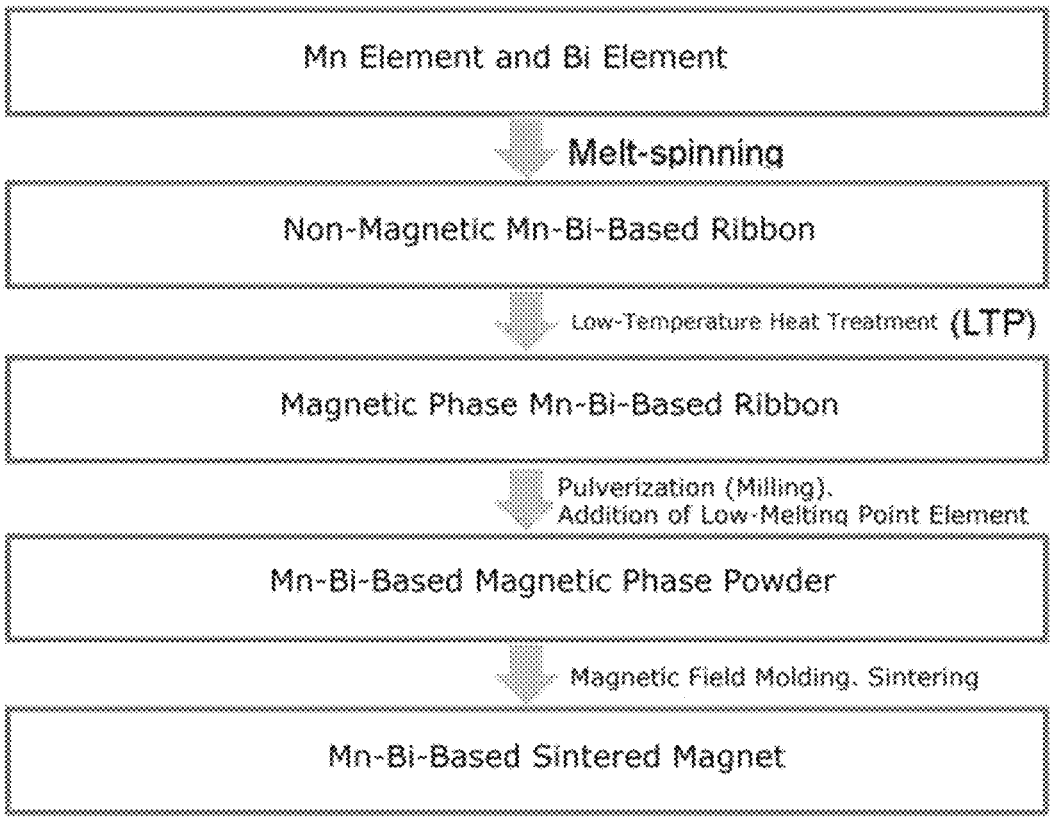

【Fig. 2】
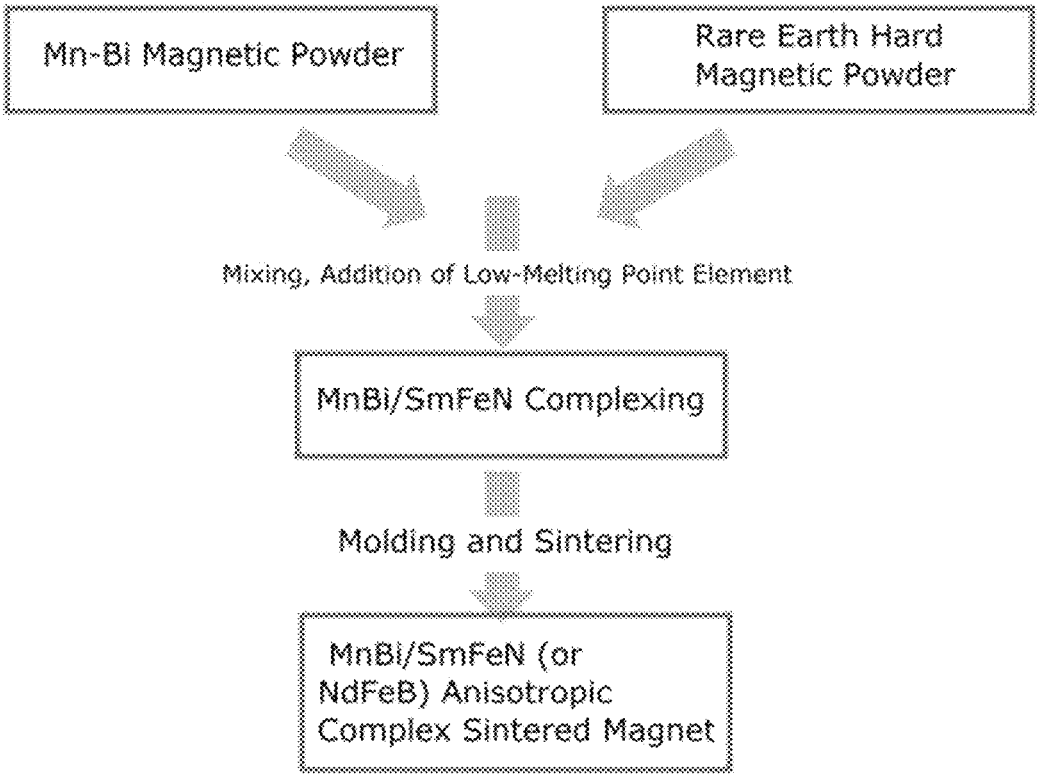

【Fig. 3】
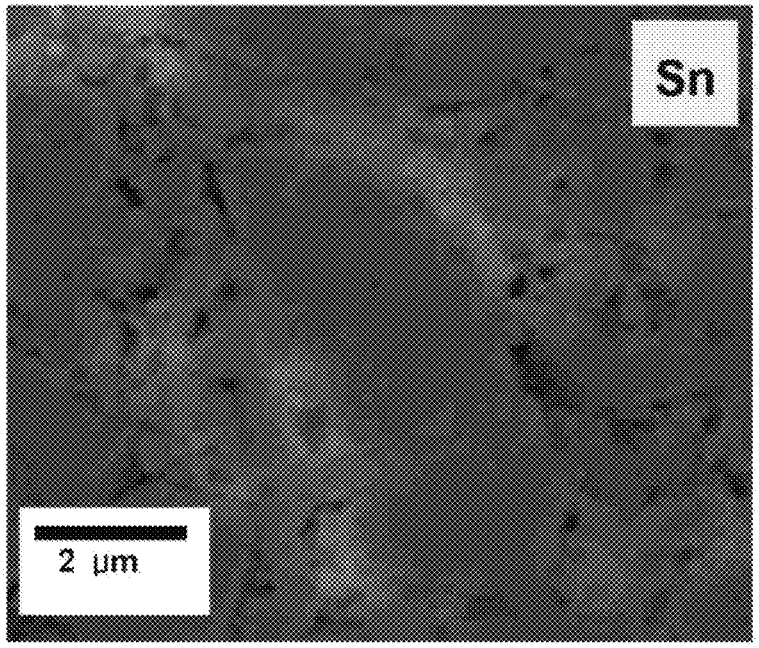
【Fig. 4】
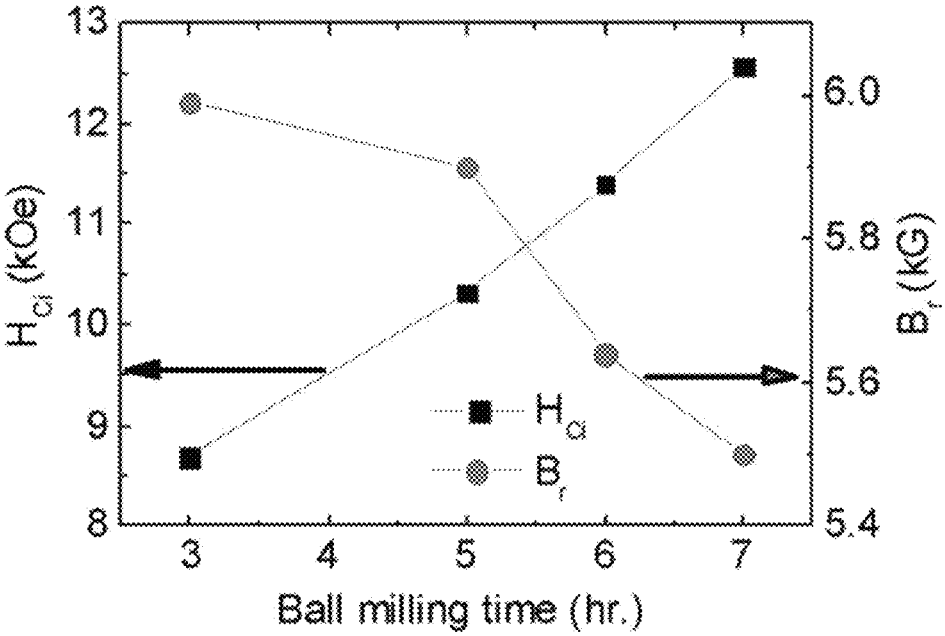

SINTERED MAGNET BASED ON MNBI HAVING IMPROVED HEAT STABILITY AND METHOD OF PREPARING THE SAME

CROSS REFERENCE TO RELATED APPLICATIONS

This application is a Continuation of PCT International Application No. PCT/KR2015/006434, filed on Jun. 24, 2015, which claims priority under 35 U.S.C. 119(a) to Patent Application No. 10-2015-0060676, filed in Republic of Korea on Apr. 29, 2015, all of which are hereby expressly incorporated by reference into the present application.

TECHNICAL FIELD

The present invention relates to an MnBi-based sintered magnet with improved thermal stability and a method of preparing the same.

More particularly, the present invention relates to an MnBi sintered magnet exhibiting excellent thermal stability as well as excellent magnetic characteristics at high temperature, an MnBi anisotropic complex sintered magnet, and a method of preparing the same.

BACKGROUND ART

Neodymium magnets are a molding sintered product including neodymium (Nd), iron oxide (Fe), and boron (B) as main components, and exhibit excellent magnetic characteristics. One of the methods for securing high coercive force of a neodymium magnetic powder is a method for using the neodymium magnetic powder by adding a heavy rare earth such as Dy to increase coercive force at room temperature. However, it seems that there is a limitation in recently using a heavy rare earth metal such as Dy as a material in the future due to the scarcity of the heavy rare earth metal and a soaring increase in prices resulting therefrom.

As described above, the imbalance problems between demand and supply of rare earth element resources have become a big obstacle to the supply of high-performance motors required for the next-generation industry, and therefore, there is a need for developing a novel high-performance magnetic material capable of replacing rare earth magnets.

Meanwhile, MnBi in the low-temperature phase (LTP) exhibiting ferromagnetic characteristics is a rare earth-free material permanent magnet, and is characterized to have a larger coercive force than an $Nd_2Fe_{14}B$ permanent magnet at a temperature of 150° C. or more because the coercive force has a positive temperature coefficient at a temperature interval of −123 to 277° C.

Therefore, an MnBi-based magnet is a material suitable for being applied to motors which are driven at high temperature (100 to 200° C.). When compared to other magnets in terms of the $(BH)_{max}$ value which exhibits a magnetic performance index, the MnBi-based magnet is better than the existing ferrite permanent magnet in terms of performance and may implement a performance which is equal to or more than that of rare earth $Nd_2Fe_{14}B$ bond magnets, and thus is a material capable of replacing these magnets.

Throughout the present specification, a plurality of documents are referenced, and citations thereof are indicated. The disclosure of each of the cited documents is incorporated herein by reference in its entirety to describe the level of the technical field to which the present invention pertains and the content of the present invention more apparently.

DISCLOSURE OF THE INVENTION

As a result of conducting studies for replacing rare earth magnets in the related art, the present inventors have succeeded in preparing a single-phase LTP MnBi and MnBi-based sintered magnet having excellent magnetic characteristics at high temperature through a method of simultaneously melting and rapidly cooling Mn and Bi, in which the difference in melting points of the two elements is as high as 975° C. or more.

Meanwhile, MnBi permanent magnets in the related art have a problem in that the magnet has a relatively lower saturation magnetization value (theoretically ~80 emu/g) than rare earth permanent magnets. Therefore, when MnBi and a rare earth hard magnetic phase are prepared into a complex sintered magnet, a low saturation magnetization value may be improved. Further, the temperature stability may be secured through the complexing of MnBi having a positive temperature coefficient and a rare earth hard magnetic phase having a negative temperature coefficient for the coercive force. However, a rare earth hard magnetic phase such as SmFeN has a disadvantage in that the rare earth hard magnetic phase fails to be used as a sintered magnet due to a problem in that the phase is decomposed at high temperature (~600° C. or more).

Under these circumstances, the present inventors have found that in preparing a complex magnet including MnBi and a rare earth hard magnetic phase, when an MnBi ribbon is prepared by a rapidly solidification process (RSP) to form an MnBi microcrystalline phase, the rare earth hard magnetic phase which is difficult to sinter at 300° C. or less may be sintered together, and an anisotropic sintered magnet may be prepared through the complexing of an MnBi powder and a rare earth hard magnetic phase powder, and as a result, the anisotropic sintered magnet has excellent magnetic characteristics.

Furthermore, the present inventors have found out that if a low-melting point metal is diffused into the grain boundary of crystal grains of the MnBi sintered magnet or MnBi anisotropic complex sintered magnet as prepared above, the sintered magnet gets to have excellent thermal stability over a wide rage of temperature, and in particular, excellent magnetic characteristics at high temperature, thereby completing the present invention.

Therefore, an object of the present invention is to provide an MnBi-based sintered magnet having excellent thermal stability.

Another object of the present invention is to provide an MnBi-based sintered magnet having excellent magnetic characteristics.

Still another object of the present invention is to provide a method of preparing an MnBi-based sintered magnet having excellent thermal stability and excellent magnetic characteristics at high temperature.

The other objects and advantages of the present invention will be more apparent from the following detailed description, claims and drawings of the invention.

An aspect of the present invention relates to an MnBi-based sintered magnet including MnBi phase particles, in which the MnBi-based sintered magnet includes a low-melting point metal at the interface between particles.

A general sintered magnet is easily demagnetized because the Bi-rich phase is incompletely formed in the interface between particles or the interface of the main phase becomes roughened. In the present invention, the addition of a low-melting point metal is a method for reinforcing the interface between particles, and is intended to prevent the reversal of the magnetic field produced from a crystal particle from propagating to adjacent crystal particles.

However, in the present invention, the introduction of a low-melting point metal does not bring about just an effect of improving the coercive force. As a result of preparing a sintered magnet by applying a low-melting point metal to the grain boundary of an MnBi sintered magnet or MnBi anisotropic complex to be used for a motor driven at high temperature, and the like, the present inventors have surprisingly found that not only the increasing of the coercive force, but also excellent thermal stability over a wide range of temperature are obtained. Furthermore, magnetic characteristics become excellent particularly at high temperature.

Thus, in an exemplary embodiment, the present invention provides a sintered magnet which is characterized in that a change in coercive force is minimized over a wide temperature interval of −50 to 277° C. by applying a low-melting point metal to the interface between the particles (securing of excellent thermal stability).

In another exemplary embodiment, the present invention provides a sintered magnet which is characterized in that by applying a low-melting point metal to the interface between particles, a higher maximum energy product is obtained at a high temperature of 100 to 277° C., preferably a temperature of 100 to 200° C., compared to a case where the low-melting point metal is not included (securing of excellent high-temperature magnetic characteristics).

As the low-melting point metal included in the sintered magnet of the present invention, it is possible to use one or more selected from the group consisting of Sn, Bi, Zn, Bi—Sn, Bi—Zn, Sn—Zn, Bi—Sn—Zn, and Ag—Bi—Zn.

The low-melting point metal may be included in an amount of more than 0 to 10 wt % with respect to the total weight of the sintered magnet.

The MnBi-based sintered magnet of the present invention includes MnBi phase particles as a main phase, and the composition thereof may be a composition in which when MnBi is represented by $Mn_xBi_{100-x}$, X is 50 to 55, and may have preferably a composition of $Mn_{50}Bi_{50}$, $Mn_{51}Bi_{49}$, $Mn_{52}Bi_{48}$, $Mn_{53}Bi_{47}$, $Mn_{54}Bi_{46}$, and $Mn_{55}Bi_{45}$.

Further, the sintered magnet of the present invention may further include rare earth hard magnetic phase particles in addition to MnBi phase particles. That is, the low-melting point metal in the present invention may also be applied to the grain boundary surface of not only the MnBi sintered magnet, but also the MnBi anisotropic complex sintered magnet including rare earth hard magnetic phase particles, and in this case, the rare earth hard magnetic phase may be represented by R—CO, R—Fe—B, or R—Fe—N (here, R is a rare earth element selected from the group consisting of Sc, Y, La, Ce, Pr, Nd, Pm, Sm, Eu, Gd, Tb, Dy, Ho, Er, Tm, Yb, and Lu), or may be preferably represented by SmFeN, NdFeB, or SmCo.

When the sintered magnet of the present invention further includes a rare earth hard magnetic phase powder as described above, MnBi, the low-melting point metal, and the rare earth hard magnetic phase may be included in an amount of 55 to 99.9 wt %, more than 0 to 10 wt %, and 0 to 45 wt %, respectively. If the content of the rare earth hard magnetic phase exceeds 45 wt %, there is a disadvantage in that it is difficult to perform the sintering.

In a preferred exemplary embodiment, when SmFeN is used as the rare earth hard magnetic phase, the content may be 5 to 40 wt %.

The MnBi-based sintered magnet in which the low-melting point metal is included in the grain boundary of the present invention as described above may be widely used for a motor for a refrigerator and air-conditioner compressor, a washing-machine driving motor, a mobile handset vibration motor, a speaker, a voice coil motor, the determination of the positions of a hard disk head for a computer by a linear motor, a zoom, an iris diaphragm, and a shutter of a camera, an actuator of a micromachining system, an automotive electrical part such as a dual clutch transmission (DCT), an anti-lock brake system (ABS), an electric power steering (EPS) motor, and a fuel pump, and the like due to excellent thermal stability and excellent magnetic characteristics at high temperature.

Another aspect of the present invention provides a method of preparing the MnBi-based sintered magnet of claim 1, the method including: (a) preparing a non-magnetic phase MnBi-based alloy; (b) subjecting the prepared non-magnetic phase MnBi-based alloy to heat treatment to be converted into a magnetic phase MnBi-based alloy; (c) pulverizing the prepared magnetic phase alloy to prepare an MnBi hard magnetic phase powder; (d) adding a low-melting point metal powder to the MnBi hard magnetic phase powder to mix the powders; (e) subjecting the mixture to magnetic field molding while applying external magnetic field thereto; and (f) sintering the molded product.

(a) Preparing of Non-Magnetic Phase MnBi-Based Alloy

In the method of the present invention, the preparing of the non-magnetic phase MnBi-based alloy may be performed by preparing an Mn—Bi mixed melt, and forming a non-magnetic phase MnBi-based alloy therefrom.

The preparation of the Mn—Bi mixed melt may be performed by mixing a manganese-based material with a bismuth-based material, and then rapidly heating the resulting mixture, and here, the manganese-based material and the bismuth-based material may be a solid powder of a metal including manganese (Mn) and bismuth (Bi), respectively.

The preparation of the mixed melt may be performed at a temperature of 1,200° C. or more. The melting point of Mn is 1,246° C., the melting point of Bi is about 271.5° C., a temperature of about 1,200° C. or more is required to simultaneously melt the metals, and as the melting method, it is possible to apply, for example, an induction heating process, an arc-melting process, a mechanochemical process, a sintering process, or a combination thereof, and the like, and the melting method may be generally a rapid heating process including these methods.

As the next step, a process of cooling the mixed melt to form a non-magnetic phase Mn—Bi-based alloy may be performed. Here, the cooling of the mixed melt may be a rapid cooling process, and the rapid cooling process may include any one selected from the group consisting of, for example, a rapid solidification process (RSP), an atomizer process, and a combination thereof.

The difference in melting points of Mn and Bi is so great that when the cooling rate is not maintained at a high level, crystals with a significantly large size may be formed, and when the crystal size is large, a smooth diffusion reaction may not occur in a low-temperature heat treatment to be subsequently performed.

Thus, as a rapid cooling process which increases the cooling rate, a rapid solidification process (RSP) may be preferable, and a wheel speed in the rapid solidification process may be 55 to 75 m/s, preferably 60 to 70 m/s. When the wheel speed is less than 55 m/s, the crystal size of Mn in the non-magnetic phase Mn—Bi-based alloy is significantly large, and the distribution of the Mn, Bi, and MnBi phases is so non-uniform that a smooth diffusion of Mn may not occur in a low-temperature heat treatment step in which a peritetic reaction subsequently occurs, and accordingly, the ferromagnetic MnBi low-temperature phase fails to be formed, so that magnetic characteristics may not be good, and when the wheel speed exceeds 75 m/s, there is a concern in that minimal crystals for being converted into the magnetic phase may not be formed, an amorphous state alloy is formed, and thus magnetic characteristics may not be obtained.

That is, when the wheel speed in the rapid solidification process is adjusted to 55 to 75 m/s, the crystal sizes of Mn, Bi, and MnBi phases may be in the nanoscale, the three phases may be uniformly distributed, and accordingly, a non-magnetic phase Mn—Bi-based alloy may be formed as a state where Mn and the like may easily diffuse during a low-temperature heat treatment.

The size of crystal grains in the non-magnetic-phase MnBi-based alloy formed through the cooling of the mixed melt as described above may be 100 nm or less, preferably 50 to 100 nm.

The non-magnetic phase MnBi-based ribbon prepared may comprise non-magnetic phase in an amount of 90% or more, preferably 99% or more. If non-magnetic phase MnBi-based ribbon comprises 90% or more of non-magnetic phase, it is possible to inhibit rapid grain growth in the heat treatment for forming an MnBi low temperature phase (LTP), and to have uniform MnBi LTP.

(b) Converting Non-Magnetic Phase MnBi-Based Alloy into Magnetic Phase MnBi-Based Alloy The present step is a step of subjecting the non-magnetic phase MnBi-based alloy formed in step (a) to heat treatment to be converted into a magnetic phase alloy.

Here, the heat treatment may be performed at a temperature of 280 to 340° C., preferably 300 to 320° C., and may also be performed under a high vacuum pressure of 5 mPa or less. The heat treatment may be performed through a process referred to as a low-temperature heat treatment, and due to the low heat treatment process, a peritetic reaction in which Mn crystals diffuse occurs, and accordingly, an MnBi low-temperature phase (MnBi LTP) may be formed, and the MnBi-based alloy may have magnetic characteristics because the mono phase MnBi low-temperature phase is ferromagnetic.

The heat treatment may be performed for 2 to 5 hours, preferably 3 to 4 hours, induces diffusion of Mn included in the non-magnetic phase Mn—Bi-based alloy, and may include a heat treatment process which forms an MnBi low-temperature phase.

According to methods in the related art, the difference in melting points of Mn and Bi is so great that when these metals are cooled, a portion of Mn is first precipitated, and accordingly, the phases are non-uniformly distributed in the Mn—Bi-based alloy finally formed, and the crystal size of Mn is also significantly large. Further, the metal first precipitated is solidified in a shape which surrounds the metal which is later precipitated, thereby making it difficult for Mn to diffuse during the low-temperature heat treatment, and since the heat treatment is performed at low temperature, a long-term heat treatment exceeding almost 24 hours is required for Mn to sufficiently diffuse.

However, when a method such as rapid cooling adopted by the present inventors is used, significantly small size crystals such as Mn and Bi may be formed, and accordingly, even though the low-temperature heat treatment is performed for only about 2 to 5 hours, Mn may sufficiently diffuse, and it is possible to prepare an MnBi-based alloy having excellent magnetic characteristics due to the smooth formation of the MnBi low-temperature phase. Furthermore, the time may also be significantly reduced, even though the heat treatment is also performed at a low temperature, so that it is also possible to prevent a coarsening phenomenon in which crystal grains grow, become fused with each other, and increase the size of crystal grains, and additionally, it is also possible to obtain an energy-saving effect.

(c) Pulverizing Magnetic Phase Alloy to Prepare MnBi Hard Magnetic Phase Powder

As the next step, an MnBi hard magnetic phase powder is prepared by pulverizing the magnetic phase MnBi alloy.

In the process of pulverizing the MnBi hard magnetic phase powder, the pulverization efficiency may be enhanced and the dispersibility may be improved preferably through a process using a dispersing agent. As the dispersing agent, a dispersing agent selected from the group consisting of oleic acid ($C_{18}H_{34}O_2$), oleyl amine ($C_{18}H_{37}N$), polyvinylpyrrolidone, and polysorbate may be used, but the dispersing agent is not necessarily limited thereto, and oleic acid may be included in an amount of 1 to 10 wt % with respect to the powder.

In the process of pulverizing the MnBi hard magnetic phase powder, a ball milling may be used, and in this case, the ratio of the ratio of a magnetic phase powder, balls, a solvent, and a dispersing agent is about 1:20:6:0.12 (by mass), and the ball milling may be performed by setting the balls to Φ3 to Φ5.

According to an exemplary embodiment of the present invention, the process of pulverizing the MnBi hard magnetic phase may be performed for 3 to 8 hours, and the size of the MnBi hard magnetic phase powder completely subjected to LTP heat treatment and pulverization process as described above may be 0.5 to 5 μm in diameter.

(d) Adding Low-Melting Point Metal Powder to MnBi Hard Magnetic Phase Powder to Mix Powders In the method of the present invention, the low-melting point metal powder is applied to a step of preparing magnetic particles, and thus may be mixed with the MnBi hard magnetic phase powder.

It the non-magnetic alloy is added thereto in a step of preparing an MnBi ingot raw material, the non-magnetic phase is present in the particles, and there is a concern in that an excessive addition of the alloy may adversely affect the magnetic characteristics. In contrast, when the low-melting point metal powder is applied thereto in the step of preparing the magnetic particles as in the method of the present invention, there is an advantage in that only a small amount of the non-magnetic alloy may be sufficiently distributed at the interface between the crystal grains because the low-melting point metal is not distributed in the main phase particles.

Further, if the non-magnetic metal is coated on the surface to induce the diffusion into the inside thereof, diffusion does not proceed from the surface of the magnet. Therefore, the non-magnetic alloy fails to be sufficiently distributed to the interface of the inside crystal grains, that is, the core portion of the magnet, so that a significant magnetic shielding effect may not be obtained.

As a low-melting point metal included in the sintered magnet of the present invention, it is preferred to use a low-melting point metal having affinity with the bismuth phase, and the specific type and addition amount of low-melting point metal are as described above.

In the present step, a lubricant may also be used when the low-melting point powder is added to the MnBi hard phase powder.

When the powder particles are mixed in the presence of the lubricant, there is an advantage in that the powder particles are easily aligned while filling voids when external pressure is applied thereto in the subsequent magnetic field molding step.

Examples of the lubricant include ethyl butyrate, methyl caprylate, ethyl laurate, or stearates, and the like, and preferably, methyl caprylate, ethyl laurate, zinc stearate, and the like may be used, but the lubricant is not necessarily limited thereto.

According to an exemplary embodiment of the present invention, the pulverizing of the magnetic phase alloy to prepare an MnBi hard magnetic phase powder (c) and the adding of the low-melting point metal powder to the MnBi hard magnetic phase powder to mix the powders (d) may be simultaneously performed, and specifically, the processes of pulverization and mixing may also be simultaneously conducted by a method in which the low-melting point metal is added thereto during the milling of the MnBi magnetic phase alloy to perform the milling process of pulverization and mixing.

Another exemplary embodiment of the present invention, when the low-melting point metal powder is added to the MnBi hard magnetic phase powder to mix the powders, a rare earth hard magnetic phase powder may be further added thereto to mix the powders. The type and amount of rare earth hard magnetic phase powder to be added cite the above-described description.

In this case, apart from the process of preparing the MnBi hard magnetic phase powder and the low-melting point metal powder, the rare earth hard magnetic phase powder may be separately prepared and mixed together, or the process of uniformly mixing the powders with the pulverization may be simultaneously performed by adding the low-melting point metal and the hard phase magnetic powder during the milling of the MnBi magnetic phase alloy.

In the step of the present invention, when the rare earth hard magnetic phase powder is further added thereto to mix the powders, an MnBi anisotropic complex sintered magnet is obtained.

(e) Subjecting Mixture to Magnetic Field Molding While Applying Magnetic Field

In the present step, for the alloy powder mixture, the anisotropy is secured by orienting the magnetic field direction in parallel with the C-axis direction of the powder through a magnetic field molding process. The anisotropic magnet which secures anisotropy in a uniaxial direction through the magnetic field molding as described above has excellent magnetic characteristics compared to isotropic magnets.

The magnetic field molding may be performed using a magnetic field injection molding machine, a magnetic field molding press, and the like, and may be performed using an axial die pressing (ADP) method, a transverse die pressing (TDP) method, and the like, but the method is not necessarily limited thereto.

The magnetic field molding step may be performed under a magnetic field of 0.1 to 5.0 T, 0.5 to 3.0 T, or 1.0 to 2.0 T.

(f) Sintering of the Molded Product

As a selective heat treatment at low temperature in order to suppress the growth of particles and the oxidation during the preparation of a densified magnet, hot press sintering, hot isotactic pressure sintering, spark plasma sintering, furnace sintering, microwave sintering, and the like may be used, but the heat treatment is not necessarily limited thereto.

The MnBi-based sintered magnet including the low-melting point metal of the present invention in the grain boundary of crystal grains has an advantage in that the magnet has excellent thermal stability over a wide temperature interval, and excellent magnetic characteristics particularly at high temperature.

BRIEF DESCRIPTION OF THE DRAWINGS

FIG. 1 illustrates a schematic view of the process of preparing an MnBi sintered magnet with improved thermal stability according to an exemplary embodiment of the present invention;

FIG. 2 illustrates a schematic view of a process of complexing an MnBi hard magnetic phase powder/rare earth hard magnetic phase powder and preparing an anisotropic sintered magnet with improved thermal stability according to an exemplary embodiment;

FIG. 3 illustrates a result of observing the micro structure of the MnBi sintered magnet to which Sn is added in an amount of 2 wt % through the measurement of energy dispersive X-ray spectrometry (EDS) selected area scanning. The yellow color indicates Sn; and FIG. 4 is a graph illustrating the relationship between intrinsic coercive force (HCi) and residual flux density (Br) of an MnBi sintered magnet to which an Sn powder is added in an amount of 2 wt % over the ball milling time according to an exemplary embodiment of the present invention.

MODES FOR CARRYING OUT THE PREFERRED EMBODIMENTS

Hereinafter, the present invention will be described in more detail through the Examples. These Examples are provided only for more specifically describing the present invention, and it will be obvious to a person with ordinary skill in the art to which the present invention pertains that the scope of the present invention is not limited by these Examples.

EXAMPLE

<Preparation and Magnetic Characteristics of MnBi Sintered Magent>

1. Preparation of MnBi Sintered Magnet Including Low-Melting Point Metal at Grain Boundary First, manganese (Mn) metal particles and bismuth (Bi) metal particles were mixed, and the mixed powder was charged into a furnace, and then melted through an induction heating method. In this case, the temperature of the furnace was instantaneously increased to 1,400° C. to prepare a mixed melt. And then, the mixed melt was injected into a cooling wheel in which the wheel speed was adjusted to about 65 m/s to prepare a non-magnetic phase MnBi-based ribbon in the solid state through a rapid cooling method.

The non-magnetic phase MnBi-based ribbon prepared may comprise non-magnetic phase in an amount of 90% or more, preferably 99% or more. If non-magnetic phase MnBi-based ribbon comprises 90% or more of non-magnetic phase, it is possible to inhibit rapid grain growth in the heat treatment for forming an MnBi low temperature phase (LTP), and to have uniform MnBi LTP.

In order to impart magnetic characteristics to the non-magnetic MnBi ribbon thus prepared, a low-temperature heat treatment was performed under the vacuum and inert gas atmosphere conditions to prepare an MnBi-based magnetic body.

And then, a process of pulverizing the magnetic body using a ball milling was performed, and during the milling of the MnBi magnetic body, Sn was added thereto in an amount of 0 wt %, 1 wt %, and 2 wt %, respectively, and the milling process of pulverization and mixing was simultaneously performed.

In particular, when the Sn powder was included in an amount of 2 wt %, the milling process was performed for the ball milling time of 3, 5, 6, and 7 hours, respectively to prepare a mixed powder in order to evaluate the effect of the ball milling time.

Each of the mixed powder thus prepared was subjected to magnetic field molding under a magnetic field of about 1.6 T, and then sintered to an MnBi sintered magnet to which the low-melting point metal was added.

In order to analyze the micro structure of the MnBi sintered magnet to which Sn was added in an amount of 2 wt % in the sintered magnet thus prepared, the distribution of Sn at the grain boundary surface was observed through the scanning measurement of the energy dispersive X-ray spectrometry selective region, and is illustrated in FIG. 3. In FIG. 3, the yellow color indicates Sn, and it can be confirmed that Sn is distributed at the boundary surface of crystal grains.

2. Measurement of Magnetic Characteristics of MnBi Sintered Magnet According to Amount of Low-Melting Point Metal Added The intrinsic coercive force ($H_{Ci}$), residual flux density ($B_r$), induced coercive force ($H_{CB}$), density, and maximum magnetic energy product [$(BH)_{max}$] of the MnBi sintered magnet with improved thermal stability were measured, and the magnetic characteristics were measured at normal temperature (25° C.) using a vibrating sample magnetometer (VSM, Lake Shore #7300 USA, maximum 25 kOe), and the values are shown in the following Table 1.

TABLE 1

| MnBi Sintered Manet | $H_{Ci}$ (kOe) | $B_r$ (kG) | $H_{CB}$ (kG) | Density (g/cm$^3$) | $(BH)_{max}$ (MGOe) |
|---|---|---|---|---|---|
| Sn 2 wt % Addition | 8.7 | 6.0 | 5.4 | 8.2 | 8.3 |
| Sn 1 wt % Addition | 7.5 | 6.1 | 5.2 | 8.2 | 8.4 |
| Sn 0 wt % Addition | 5.1 | 6.4 | 4.8 | 8.3 | 9.4 |

Through Table 1, it can be confirmed that when the Sn powder was added in an amount of 2 wt %, the intrinsic coercive force was increased from 5.1 kOe to 8.7 kOe. The increase in intrinsic coercive force brings about a magnetic insulation effect, and thus improves the coercive force by maximally suppressing the generation of magnetization reversal due to the production and growth of a reverse magnetic domain produced from the surface of crystal grains because Sn is formed along the grain boundary.

When defects are not present and only a domain and a domain wall are present inside the crystal grains in a general magnetic material, if external magnetic field is applied thereto, the domain is aligned in the same direction as the external magnetic field while the domain wall easily moves, so that saturation is achieved at low magnetic field. When the magnetic field is applied thereto in a state where saturation is achieved, domains are rotated at 180° at certain magnetic field, and in this case, the external magnetic field value will be the coercive force.

As confirmed in FIG. 3, the diffusion of the low-melting point metal into the grain boundary brings about a result in which the coercive may be increased while reducing a decrease in the residual magnetization value. The decrease in the residual magnetization value is thought to be due to an effect resulting from the increase in content of the non-magnetic phase Sn.

3. Measurement of Magnetic Characteristics of MnBi Sintered Magnet According to Ball Milling Time As the case where the Sn powder is included in an amount of 2 wt %, the intrinsic coercive force ($H_{Ci}$), residual flux density ($B_r$), induced coercive force ($H_{CB}$), density, and maximum magnetic energy product [$(BH)_{max}$] were measured at normal temperature (25° C.) using a vibrating sample magnetometer (VSM, Lake Shore #7300 USA, maximum 25 kOe) in order to measure the magnetic characteristics of the MnBi sintered magnet according to the ball milling time, and the values are shown in the following Table 2.

TABLE 2

| Ball milling (hr.) | $H_{Ci}$ (kOe) | $B_r$ (kG) | $H_{CB}$ (kG) | Density (g/cm$^3$) | $(BH)_{max}$ (MGOe) |
|---|---|---|---|---|---|
| 3 | 8.7 | 6.0 | 5.4 | 8.2 | 8.3 |
| 5 | 10.3 | 5.9 | 5.3 | 8.2 | 8.0 |
| 6 | 11.4 | 5.6 | 5.2 | 8.0 | 7.5 |
| 7 | 12.6 | 5.5 | 5.2 | 8.0 | 7.3 |

From Table 2, the magnetic characteristics of the MnBi sintered magnet to which the Sn powder was added according to the ball milling time, showing a tendency that the intrinsic coercive force was increased and the residual flux density was decreased according to the increase in milling energy (ball milling time) as illustrated in FIG. 4. Due to the micronization of the powder according to the increase in milling time, the coercive force of the MnBi sintered magnet is increased.

When the crystal grains are small, a single domain is enegetically stable rather than a multi-domain, and in a permanent magnet in the multi-domain state, the magnetization reversal into adjacent domains with low energy easily propagates like a domino phenomenon, thereby leading to a decrease in coercive force. However, in the single domain state, the magnetization reversal may be generated by the larger energy, thereby limiting the demagnetization and increasing the coercive force. Further, an increase in milling weakens the crystallinity of crystal grains, and is also a factor which decreases the residual flux density.

4. Measurement of Magnetic Characteristics According to Measurement Temperature of MnBi Sintered Magnet When Low-Melting Point Metal is Added and is not Added Magnetic characteristics of an MnBi sintered magnet to which the Sn powder was added in an amount of 2 wt % (ball milling time 3 hr) and an MnBi sintered magnet to which the Sn powder was not added (ball milling time 8 hr) were measured at a measurement temperature of −40° C., 25° C., and 150° C., respectively, and the results are shown in the following Table 3.

TABLE 3

| MnBi Sintered Magnet | Measurement Temperature (° C.) | $H_{Ci}$ (kOe) | $B_r$ (kG) | $H_{CB}$ (kG) | Density (g/cm$^3$) | $(BH)_{max}$ (MGOe) |
|---|---|---|---|---|---|---|
| Sn Addition | 150 | 16.4 | 5.3 | 5.1 | 8.2 | 6.8 |
| (2 wt %) | 25 | 8.7 | 6.0 | 5.4 | 8.2 | 8.3 |
| Ball milling 3 hr. | −40 | 3.7 | 6.3 | 3.5 | 8.2 | 7.9 |
| Sn Addition | 150 | 25.0 | 5.0 | 4.8 | 8.2 | 5.9 |
| (0 wt %) | 25 | 9.7 | 6.0 | 5.5 | 8.2 | 8.2 |
| Ball milling 8 hr. | −40 | 4.3 | 6.2 | 3.9 | 8.2 | 8.0 |

As confirmed in Table 3, a long-term (7 hours or more) of ball milling time is required to show high-coercive force characteristics without adding the Sn powder, but when the Sn powder is added, high-coercive force characteristics may be obtained with the ball milling for a relatively short time.

In particular, when the Sn powder was added thereto, it was confirmed that the change width in coercive force was so narrow over a wide temperature range that high thermal stability could be secured.

Further, when the Sn powder was added thereto, a sintered magnet having high maximum magnetic energy product [$(BH)_{max}$] at particularly high temperature was prepared. In contrast, in the case of an MnBi sintered magnet prepared after a long-term ball milling was performed, it could be confirmed that due to the deterioration in crystallinity resulting from the high milling energy, the residual flux density ($B_r$) was reduced at high temperature (150° C.), and thus, the performance of the magnet relatively deteriorated.

<Preparation and Magnetic Characteristics of MnBi and Rare Earth Hard Magnetic Phase Sintered Magent>

1. Preparation of Anisotropic Complex Sintered Magnet Including Low-Melting Point Metal in Grain Boundary A mixed powder of manganese (Mn) metal particles and bismuth (Bi) metal particles was charged into a furnace, and then the temperature of the furnace was instantaneously increased to 1,400° C. to prepare a mixed melt through an induction heating method, and the mixed melt was injected into a cooling wheel in which the wheel speed was adjusted to about 65 m/s to prepare a non-magnetic phase MnBi-based ribbon in the solid state through a rapid cooling method.

The non-magnetic phase MnBi-based ribbon prepared may comprise non-magnetic phase in an amount of 90% or more, preferably 99% or more. If non-magnetic phase MnBi-based ribbon comprises 90% or more of non-magnetic phase, it is possible to inhibit rapid grain growth in the heat treatment for forming an MnBi low temperature phase (LTP), and to have uniform MnBi LTP.

In order to impart magnetic characteristics to the non-magnetic MnBi ribbon thus prepared, a low-temperature heat treatment was performed under the vacuum and inert gas atmosphere conditions to prepare an MnBi-based magnetic body.

And then, a process of pulverizing the magnetic body using a ball milling was performed, and during the milling of the MnBi magnetic body, Sn was added thereto in an amount of 0 wt %, 1 wt %, and 2 wt %, respectively, and the milling process of pulverization and mixing was simultaneously performed by adding an SmFeN hard magnetic body powder in an amount of 35 wt % thereto. In this case, a complex process was performed for 3 hours, and the ratio of the magnetic phase powder, balls, a solvent, and a dispersing agent was about 1:20:6:0.12 (by mass), and the balls were set to Φ3 to Φ5. Subsequently, the magnetic powder prepared by the ball milling was molded under a magnetic field of about 1.6 T, and then sintering was performed to prepare an MnBi/SmFeN anisotropic complex sintered magnet including a low-melting point metal.

2. Magnetic Characteristics of MnBi/SmFeN Complex Sintered Magnet According to Addition of Sn In order to measure the effects according to the addition of Sn, magnetic characteristics were measured using a vibrating sample magnetometer (VSM, Lake Shore #7300 USA, maximum 25 kOe), and the results are shown in Table 4.

TABLE 4

| MnBi/SmFeN Sintered Magnet | $H_{Ci}$ (kOe) | $B_r$ (kG) | $H_{CB}$ (kG) | Density (g/cm$^3$) | $(BH)_{max}$ (MGOe) |
|---|---|---|---|---|---|
| Sn 2 wt % Addition | 9.9 | 7.3 | 6.4 | 7.7 | 12.4 |
| Sn 0 wt % Addition | 8.7 | 7.7 | 6.6 | 7.9 | 13.8 |

From Table 4, it could be confirmed that when the Sn powder was added in an amount of 2 wt % in the MnBi/SmFeN sintered magnet prepared in the same process, the intrinsic coercive force was increased from 8.7 kOe to 9.9 kOe. The increase in intrinsic coercive force brings about a magnetic insulation effect, and thus improves the coercive force by maximally suppressing the generation of magnetization reversal due to the production and growth of reverse magnetic domain produced from the surface of crystal grains because Sn is formed along the grain boundary. The decrease in the residual magnetization value is thought to be due to an effect resulting from the increase in content of the non-magnetic phase Sn.

The invention claimed is:

1. A method of preparing a MnBi-based sintered magnet, the method comprising:

(a) preparing a non-magnetic phase MnBi-based alloy;

(b) subjecting the non-magnetic phase MnBi-based alloy to heat treatment to convert into a magnetic phase MnBi-based alloy;

(c) pulverizing the magnetic phase alloy to prepare MnBi hard magnetic phase powders;

(d) mixing the MnBi hard magnetic phase powders with a low-melting point metal powder into a mixture;

(e) molding the mixture in a magnetic field applying an external magnetic field into a molded product; and (f) sintering the molded product to obtain the MnBi-based sintered magnet comprising the MnBi hard phase powder particles and the low-melting point metal in the interface between the MnBi hard magnetic phase powder particles, wherein the low-melting point metal is Sn, wherein the MnBi-based alloy prepared in (a) has a crystal grain size of 50 to 100 nm, wherein the low-melting point metal powder is added in an amount greater than 0 wt % and less than or equal to 2 wt %, wherein the pulverizing in (c) is performed by a ball milling, and wherein a ball milling time of the ball milling is 3 to 5 hours.

2. The method of claim 1, wherein the non-magnetic phase MnBi-based alloy is prepared in (a) by a rapidly solidification process (RSP).

3. The method of claim 2, wherein a wheel speed in the rapidly solidification process is 55 to 75 m/s.

4. The method of claim 1, wherein the heat treatment is performed in (b) at a temperature of 280 to 340° C.

5. The method of claim 1, wherein (c) and (d) are simultaneously performed.

6. The method of claim 1, wherein in (d), a rare earth hard magnetic phase powder is further added to and mixed with the MnBi hard magnetic phase powders and the low-melting point metal powder.

* * * * *